United States Patent [19]

Westmoreland

[11] 4,424,012

[45] Jan. 3, 1984

[54] IN-LINE FLUID PUMP AND SHUTTLE VALVE THEREFOR

[75] Inventor: Julius C. Westmoreland, Marina Del Rey, Calif.

[73] Assignee: Inotek-Westmoreland Venture, Irvine, Calif.

[21] Appl. No.: 310,102

[22] Filed: Oct. 9, 1981

[51] Int. Cl.[3] ..... F04B 7/02; F01B 31/00

[52] U.S. Cl. ..... 417/507; 417/517; 417/518; 92/107

[58] Field of Search ..... 92/107, 108; 417/510, 417/515, 516, 517, 518, 507

[56] References Cited

U.S. PATENT DOCUMENTS

| | | | |
|---|---|---|---|
| 217,965 | 7/1879 | Waring | 92/107 |
| 268,675 | 12/1882 | Hilliker | 417/526 |
| 345,384 | 7/1886 | Knapp | 92/107 |
| 676,778 | 6/1901 | Spence et al. | 417/507 |
| 1,441,508 | 1/1923 | Jensen et al. | 417/517 |
| 1,985,642 | 12/1934 | Moody | 92/60.5 |
| 2,930,360 | 3/1960 | Yando | 92/108 |
| 3,320,902 | 5/1967 | Paschke | 417/460 |

FOREIGN PATENT DOCUMENTS

| | | | |
|---|---|---|---|
| 94487 | 8/1959 | Norway | 417/534 |

*Primary Examiner*—William L. Freeh
*Assistant Examiner*—Paul F. Neils
*Attorney, Agent, or Firm*—George J. Netter

[57] ABSTRACT

An annular piston is received within a suitably dimensioned cylinder and reciprocally driven to pump fluid on both piston strokes to a fluid carrying line with which the pump is arranged in an in-line relationship. A centrally located shuttle-valve alternately opens and closes ports at opposite ends of the pump cylinder to accomplish the required in-line valving for the pump.

5 Claims, 8 Drawing Figures

FIG. 1.
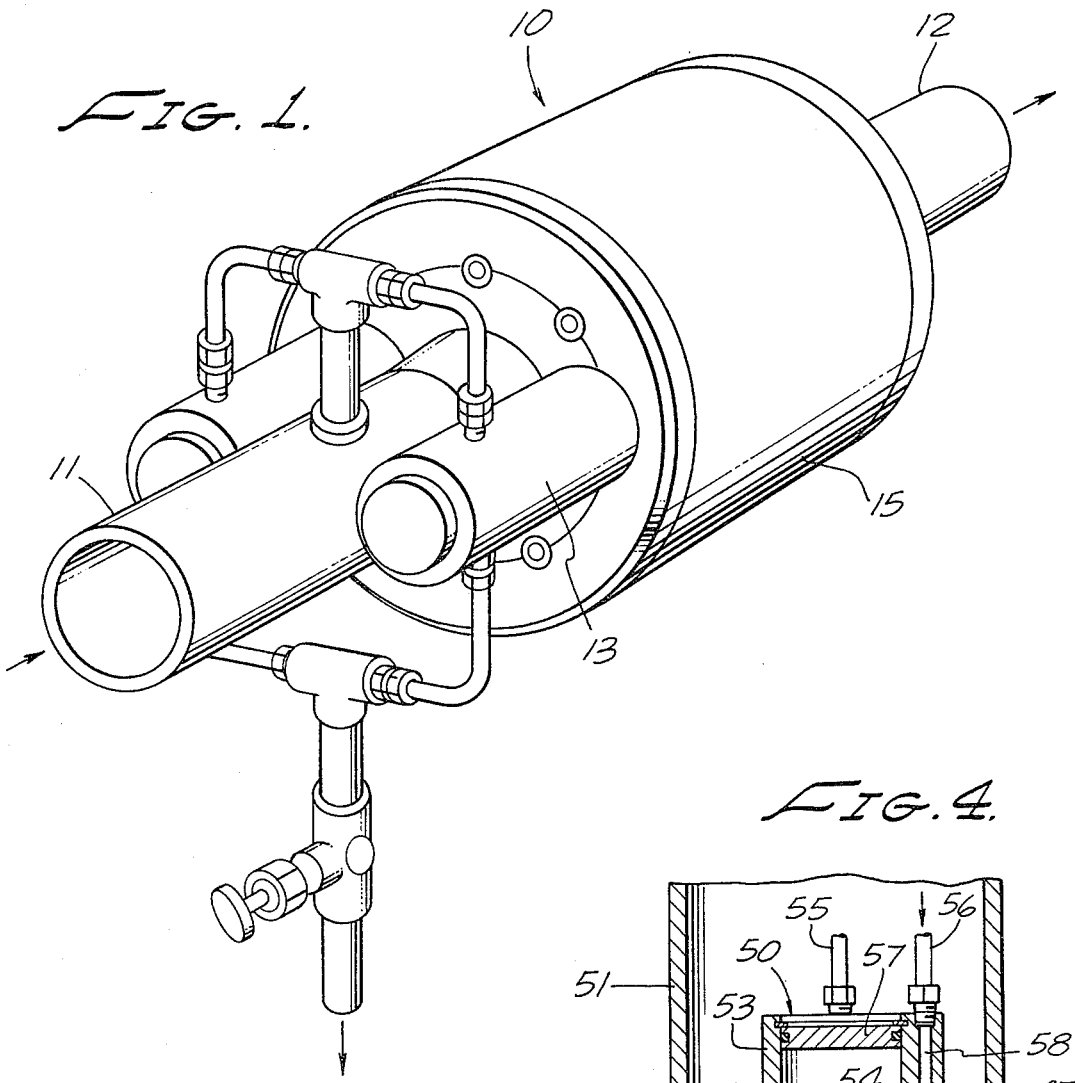
FIG. 4.
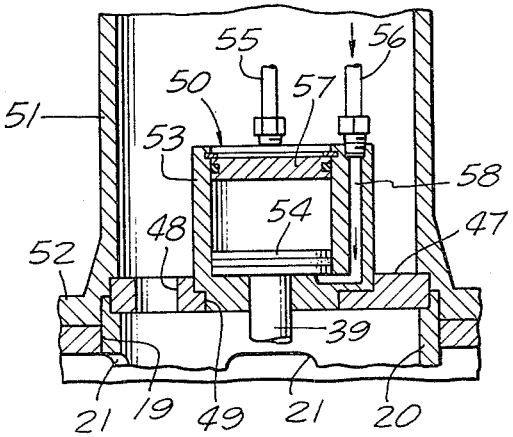
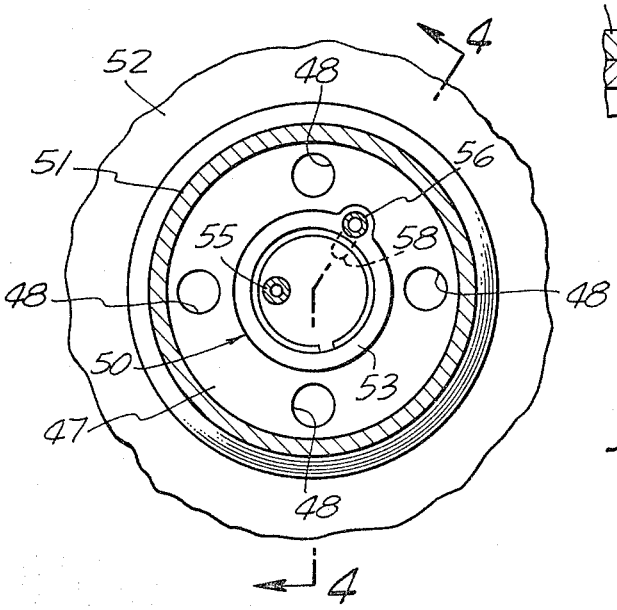
FIG. 3.

IN-LINE FLUID PUMP AND SHUTTLE VALVE THEREFOR

The present invention relates generally to a fluid pump and, more particularly, to a fluid pump for in-line operation and shuttle valve therefor.

SUMMARY OF THE PRESENT INVENTION

In the practice of the present invention, an annular piston received within a suitably dimensioned cylinder is reciprocally driven to pump fluid on both piston strokes to a fluid carrying line with which the pump is arranged in an in-line relationship. A centrally located shuttle-valve alternately opens and closes ports at opposite ends of the pump cylinder to accomplish the required in-line valving for the pump.

DESCRIPTION OF THE DRAWING

FIG. 1 is a perspective view of the fluid pump of this invention shown in assembled in-line relation to an inlet fluid line for providing pumped fluid at an increased pressure to an outlet line.

FIG. 3 is a sectional, elevational view taken along the line 3—3 of FIG. 2.

FIG. 4 is a further elevational, sectional view taken along the line 4—4 of FIG. 3.

DESCRIPTION OF A PREFERRED EMBODIMENT

Turning now to the drawings and particularly FIG. 1, the pump of this invention identified generally as at 10 is shown interconnected between an inlet fluid carrying line or pipe 11 and an outlet pipe 12, the arrows depicting the direction of fluid flow. Although other means may be employed for driving 10 it is contemplated that a hydraulic motor, such as exemplified as at 13, can be advantageously employed in this regard.

Figure 2:
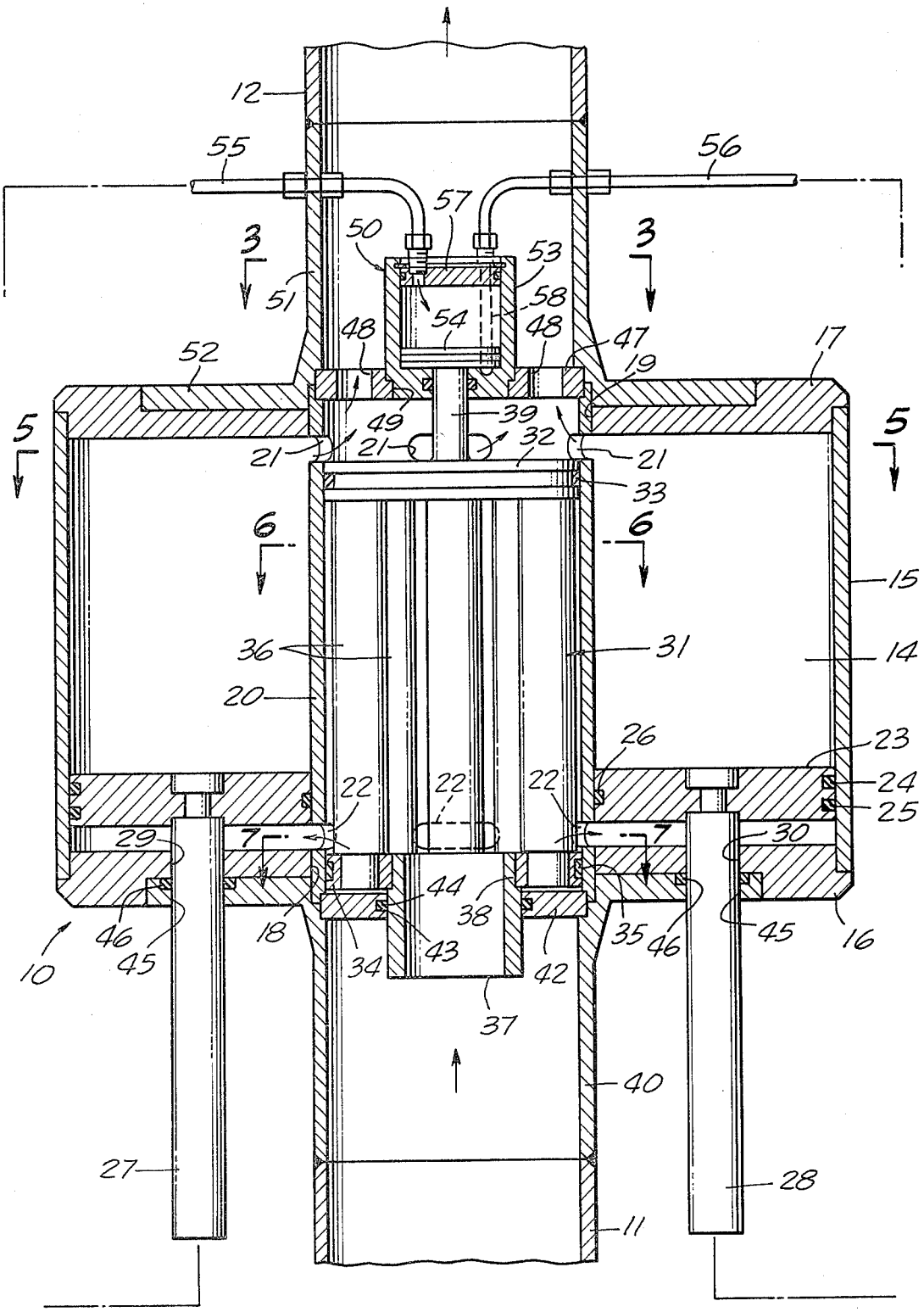
FIG. 2 is a sectional elevational view through the fluid pump of this invention shown in a first drive or pumping stroke.
Figure 5:
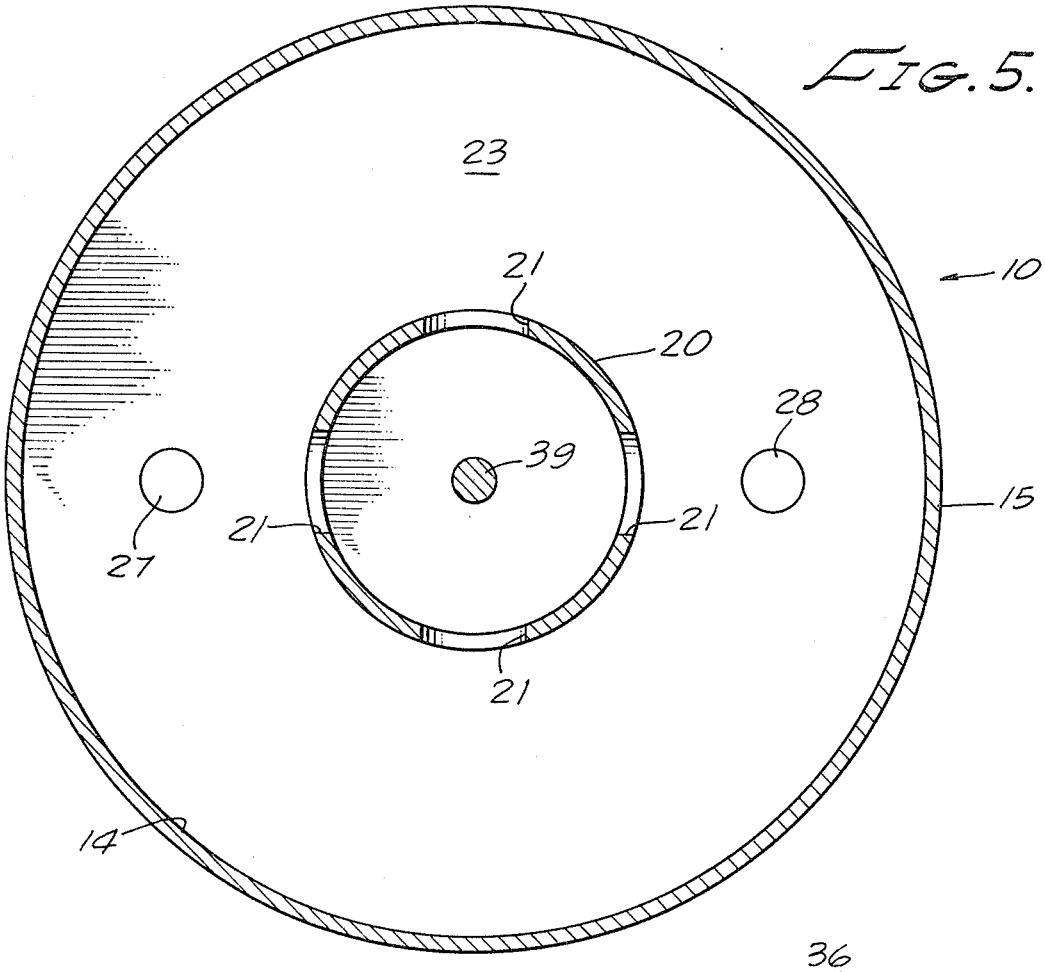
FIG. 5 is an end elevational, sectional view taken along the line 5—5 of FIG. 2.
Figure 6:
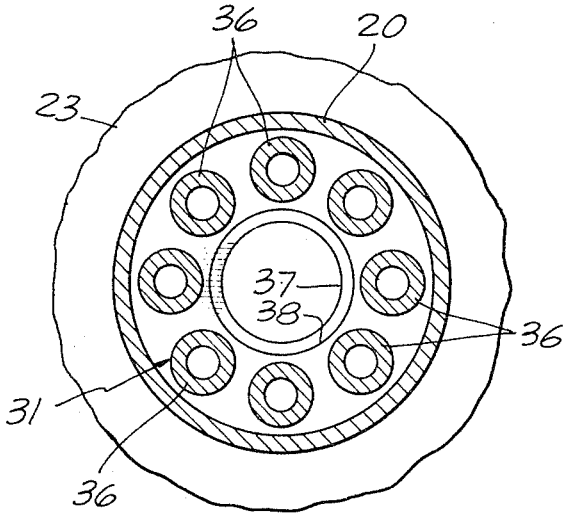
FIGS. 6 and 7 are further end elevational, sectional views taken along the lines 6—6 and 7—7, respectively, of FIG. 2.
Figure 7:
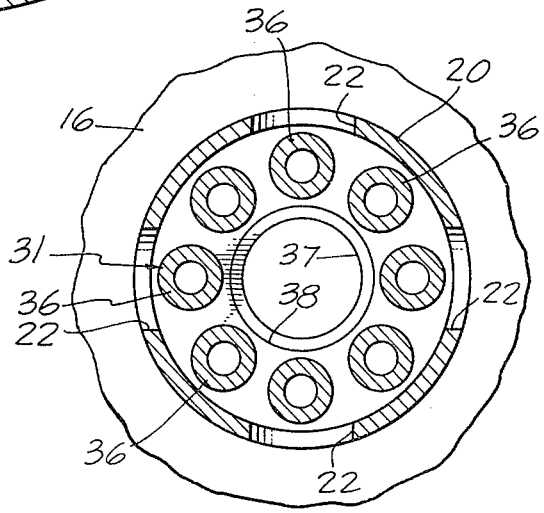

Reference is now made to FIG. 2 for the ensuing description of the detailed construction and operation of the pump 10. The chamber or cylinder 14 is annular and includes a circumferentially arranged outer wall 15, with two end plates 16 and 17 fitted about the open ends of the wall 15 to enclose the chamber. Axially located openings 18 and 19 in the end plates 16 and 17, respectively, fittingly receive a cylindrical sleeve 20 therein.

At the upper end of the cylinder as shown in FIG. 2, which can be termed the outlet end, the sleeve 20 includes a first set of circumferentially extending ports 21. These ports are arranged at the upper or outlet end extremity of the piston cylinder immediately adjacent the end plate 17 and provide communication from the internal bore of the sleeve to the chamber 14. Preferably, there are four of these slots arranged at 90 degree spacing about the cylindrical axis of 20. A similar second set of ports 22 are arranged at the opposite or inlet end of the sleeve 20.

An annular piston 23 is so dimensioned as to enable fitting receipt within the cylinder defined between the wall 15 and the sleeve 20. Sealing rings 24, 25 and 26 on the outer and inner peripheral surfaces of the piston serve to provide a sliding and sealing arrangement between the piston and the wall 15 as well as the sleeve 20. A pair of drive rods 27 and 28 each having an end affixed to the piston 23 and arranged at 180 degrees angular spacing from one another on said piston, extend through openings 29 and 30, respectively, in the end plate 16. The drive rods 27 and 28 are interconnected with the hydraulic drive motor 13 in a way well known in the art. It is important for present purposes to understand that the hydraulic motor 13, or other drive means such as an electric motor, drives the rods 27 and 28 reciprocally along a path parallel to the sleeve axis.

Figure 8:
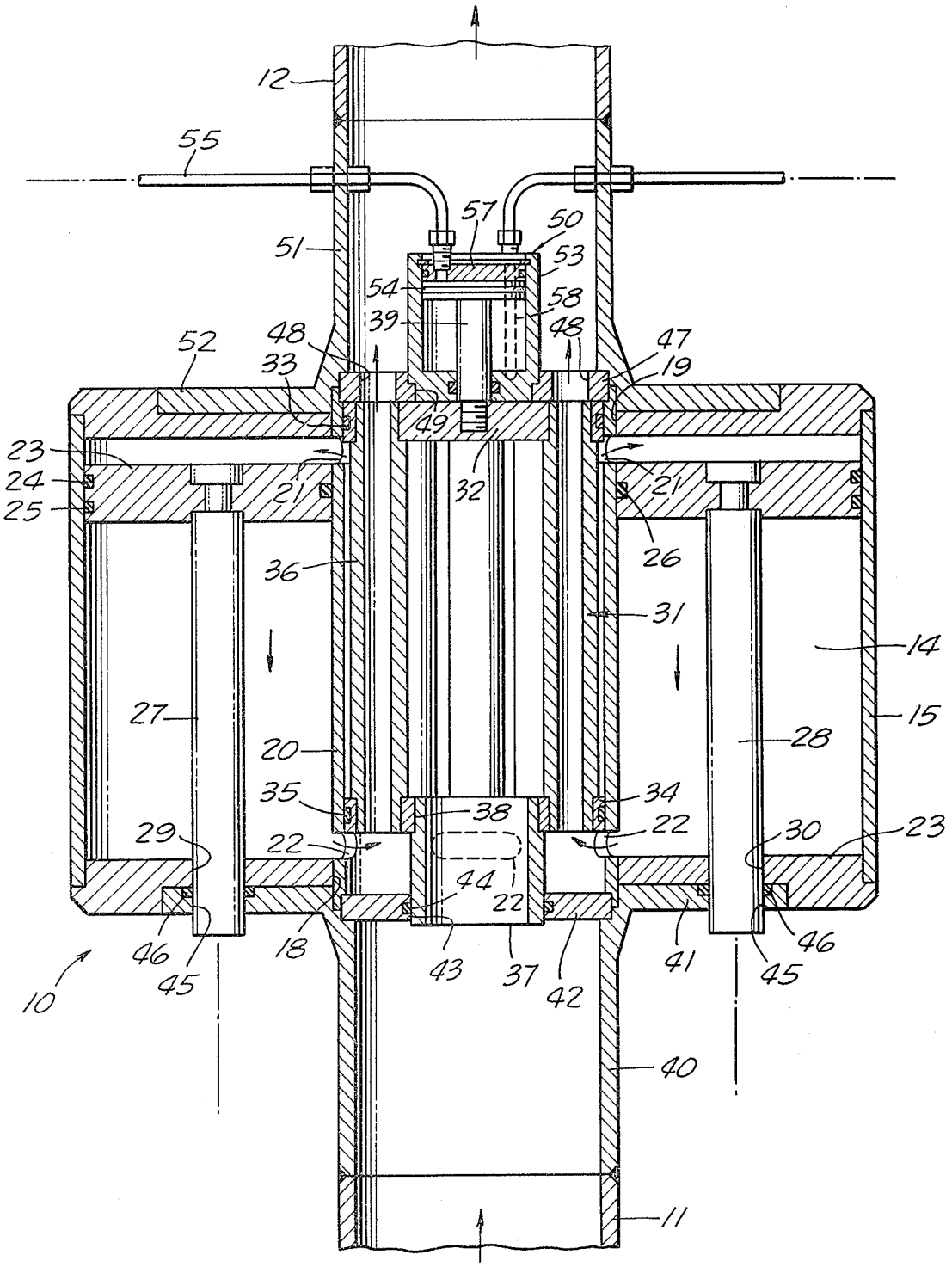
FIG. 8 is a sectional, elevational view similar to FIG. 2 depicted during a second drive or pumping stroke.

The drive rods 27, 28 provide a controlled stroke for the piston 23 from a first extreme located just above the ports 22 (FIG. 2) to a second extreme located just below the ports 21 (FIG. 8). In a way that will be described more defintively later herein, a shuttle valve identified generally as at 31 alternately closes the ports 21 while leaving ports 22 open, and then closes ports 22 while leaving ports 21 open.

SHUTTLE VALVE CONSTRUCTION

Still with reference to FIG. 2, the shuttle valve 31 accomplishes the fluid switching necessary for operation of the pump in a double-ended manner such that it will pump fluid to the outlet pipe 12 on both the upward and downward strokes. A first platelike valving member 32 is generally disk shaped and of a diameter enabling fitting receipt within the bore of the sleeve 20. A continuous seal 33 is located within a peripheral groove of the valving member 32. A further platelike valving member 34 of substantially identical dimensions to member 32 is located adjacent the inlet end of the sleeve bore and is also of such dimensions as to enable sliding receipt within the bore of the sleeve. A seal 35 also prevents fluid from leaking past the member periphery during use.

A plurality of hollow tubes 36 extend between the valving members 32 and 34 and are arranged in a circular path about the central axis of the two members maintaining the members in parallel relation. The tubes are affixed to the plates at both ends and are in communication with openings passing through the valving member surfaces such that a complete fluid passing path extends via each tube through both valving members.

A short length of open ended pipe 37 is affixed within an axially located opening 38 in valving member 34 providing a fluid passing communication through the valving to the space between the various tubes 36.

The first valving member 32 includes a drive rod 39 connecting therewith and extending axially therefrom to interconnect with a driving means to be described. The shuttle valve 31 includes the valving members 32 and 34, tubes 36 and pipe 37 all unitarily driven via rod 39 to accomplish fluid valving to the chamber 14.

IN-LINE CONNECTIONS TO PUMP

The fluid inlet line 11 includes a pipe section 40 having an enlarged circular flange 41 which is received within an accommodating declivity in the outer face of 16. The lower end of the sleeve 20 fits into a shoulder formed in the flange 41.

Also, a circular closure plate 42 fits into shoulder formed on the inner wall of pipe section 40. A centrally located opening 43 in the closure plate is dimensioned to receive the pipe 37 in sliding relation. Sealing means 44 prevents fluid flow between the pipe 37 and plate 42.

Suitable openings 45 in the flange 41 accommodate the sliding passage of drive rods 27, 28 with sealing means 46 deterring the passage of fluid therebetween.

At the opposite or outlet end of sleeve 20 there is a plate 47 having a plurality of outlet ports 48 arranged generally in a circular path about the plate axis. The plate dimensions are such as to permit receipt within and abutting against recessed shoulders in the open sleeve end. An enlarged central opening 49 receives a part of the valve driving means 50 to be described.

A pipe section 51, similar to pipe section 40, has an enlarged flange or rim 52 at one end which is suitably secured within a declivity in the outer face of plate 17. Recessed shoulders in the flange end of the pipe bore securingly engage the plate 47 and sleeve end together.

SHUTTLE VALVE DRIVE

The shuttle valve driving means 50 includes a hollow, generaly cylindrical body 53 having an outer end shaped to be fittingly received within the opening 49 such that the cylindrical bore extends away from the plate 47 along the axis of pipe section 51. A piston 54 connected to the end of drive rod 39 is adapted for sliding movement along the cylindrical bore of 53. A first fluid carrying line 55 is interconnected to a cover plate 57 for 53 which communicates to the upper end of the cylindrical chamber within which the piston 54 moves (FIG. 2). A second fluid carrying line 56 extends through a suitable fitting in the pipe section wall 51 to terminate in the plate 57 where it communicates through an internal passage with a port 58 which opens into the chamber or bore of 53 at the lowermost end.

By alternating the application of pressurized fluid through each of the lines 55 and 56 while maintaining the other line as a fluid sink, the drive rod 39 is moved by the piston alternately upwardly and downwardly as depicted in FIGS. 2 and 8 which, in turn, moves the shuttle valve 31 correspondingly. The synchronized reversing of pressurized fluid to the lines 55 and 56 is known to those skilled in the hydraulics art, and, therefore, a specific means for accomplishing this function is not disclosed.

OPERATION OF PUMP

For the ensuing description, assume the pump with associated shuttle valve 31 is in the state shown in FIG. 2. Also, assume that there is a supply of fluid to be pumped in the inlet line 11, pipe section 40 and in the cylinder or chamber 14 above the piston.

Driving action by the rods 27, 28 moves the annular piston 23 upward as shown in FIG. 2 forcing the fluid from 14 through ports 21 into the sleeve bore above valving member 32 and out through ports 48 into the outlet line 12.

This pumping action is continued until the piston reaches the limiting position shown in FIG. 8 with its upper surface just below ports 21. When this limit is reached pressurized fluid is introduced to the underside of the valve drive piston 54 via port 58 which raises the shuttle valve to the uppermost position providing open communication of the ports 21 via the space between the tubes 36 to incoming fluid through pipe section 37. The lower end of the valve is raised above ports 22 providing a fluid path from chamber 14 below piston 23, through ports 22, upward through tubes 36 and ports 48 into the outlet line.

Accordingly, as the drive rods 27 and 28 move downward from the position shown in FIG. 8, fluid is pumped downwardly by the piston, through the ports 22, through tubes 36 and thence to the outlet line 12. At the same time that part of the above piston 23 is filled with fluid entering via 37 from the inlet 11, along the outside of tubes 36 and finally through ports into the chamber.

Repeating the described stroke cycle provides a double-ended pumping action which has been found advantageous especially when operating in-line.

I claim:

1. A fluid pump comprising:

first and second coaxially arranged hollow cylinders forming an annular chamber and having end walls enclosing said chamber;

an annular piston received within and dimensioned for fitting sliding receipt along the annular chamber;

at least one drive rod connected to the annular piston and extending through an opening;

first and second ports in the inner cylinder wall located respectively at opposite ends of the chamber;

inlet means interconnecting a source of pressurized fluid with one end of the inner hollow cylinder;

outlet means interconnecting with the other end of the inner hollow cylinder;

reciprocating drive means connected to the drive rod; and valving means located within the inner cylinder synchronized with the reciprocating movement of the drive rod to interconnect the port ahead of the moving annular piston to the outlet means and the port behind the moving annular piston to the inlet means, said valving means including first and second platelike members, a plurality of spaced hollow tubes extending through the platelike members and maintaining said members at a fixed spacing, and an open-ended pipe affixed to said first platelike member and providing fluid communication between the inlet means through said first platelike member to the space between said plurality of tubes.

2. A fluid pump as in claim 1, in which the inlet and outlet means each include a straight pipe section and said sections are aligned.

3. A fluid pump as in claim 1, in which there is provided a closure plate in said inlet means having an opening within which the open-ended pipe is slidingly received.

4. A fluid pump as in claim 1, in which a valving means actuator is located within the outlet means and operates to move the valving means in synchronism with the reciprocating annular piston movement.

5. A fluid pump as in claim 4, in which the valving actuator includes a cylindrical body with included piston located within the outlet means and interconnected with the valving means to move the same in synchronism with the annular piston.

* * * * *